US010242625B2

(12) United States Patent
Xu et al.

(10) Patent No.: US 10,242,625 B2
(45) Date of Patent: Mar. 26, 2019

(54) PIXEL DRIVING CIRCUIT, PIXEL DRIVING METHOD AND DISPLAY APPARATUS

(71) Applicants: BOE TECHNOLOGY GROUP CO., LTD., Beijing (CN); HEFEI XINSHENG OPTOELECTRONICS TECHNOLOGY CO., LTD., Anhui (CN)

(72) Inventors: Pan Xu, Beijing (CN); Zhongyuan Wu, Beijing (CN); Yuting Zhang, Beijing (CN); Yongqian Li, Beijing (CN)

(73) Assignees: BOE TECHNOLOGY GROUP CO., LTD, Beijing (CN); HEFEI XINSHENG OPTOELECTRONICS TECHNOLOGY CO., LTD., Anhui (CN)

( * ) Notice: Subject to any disclaimer, the term of this patent is extended or adjusted under 35 U.S.C. 154(b) by 142 days.

(21) Appl. No.: 15/322,471

(22) PCT Filed: Mar. 21, 2016

(86) PCT No.: PCT/CN2016/076841
§ 371 (c)(1),
(2) Date: Dec. 28, 2016

(87) PCT Pub. No.: WO2016/161887
PCT Pub. Date: Oct. 13, 2016

(65) Prior Publication Data

US 2017/0140707 A1 May 18, 2017

(30) Foreign Application Priority Data

Apr. 7, 2015 (CN) ..... 2015 1 0160950

(51) Int. Cl.
*G09G 3/3233* (2016.01)
*G09G 3/3258* (2016.01)

(52) U.S. Cl.
CPC ..... *G09G 3/3258* (2013.01); *G09G 3/3233* (2013.01); *G09G 2300/0426* (2013.01);
(Continued)

(58) Field of Classification Search
CPC .. G09G 3/3258; G09G 3/3233; G09G 3/3241; G09G 3/325
See application file for complete search history.

(56) References Cited

U.S. PATENT DOCUMENTS

2009/0309856 A1 12/2009 Yoo et al.
2011/0164016 A1 7/2011 Kang et al.
2012/0120042 A1 5/2012 Tsai et al.

FOREIGN PATENT DOCUMENTS

CN 1776797 A 5/2006
CN 1855198 A 11/2006
(Continued)

OTHER PUBLICATIONS

Third Office Action for Chinese Application No. 201510160950.5, dated Sep. 22, 2017, 6 Pages.
(Continued)

*Primary Examiner* — Alexander Eisen
*Assistant Examiner* — Cory A Almeida
(74) *Attorney, Agent, or Firm* — Brooks Kushman P.C.

(57) ABSTRACT

A pixel driving circuit, a pixel driving method and a display apparatus are provided. The pixel driving circuit includes a reset unit, a threshold compensation unit, a data writing unit, a drive transistor, a first storage capacitor and a light emitting device. According to the present disclosure, it is able to make the drive current generated by the drive transistor only related to the data voltage and the reference
(Continued)

voltage but uncorrelated to the threshold voltage of the drive transistor when the drive transistor drives the light emitting device to display.

15 Claims, 6 Drawing Sheets

(52) U.S. Cl.
CPC ..... *G09G 2300/0819* (2013.01); *G09G 2300/0842* (2013.01); *G09G 2300/0861* (2013.01); *G09G 2310/0289* (2013.01); *G09G 2320/0233* (2013.01); *G09G 2320/045* (2013.01); *G09G 2330/028* (2013.01)

(56) References Cited

FOREIGN PATENT DOCUMENTS

| | | | | |
|---|---|---|---|---|
| CN | 101271665 | A | | 9/2008 |
| CN | 101325022 | A | | 12/2008 |
| CN | 101989404 | A | | 3/2011 |
| CN | 103440840 | A | * | 12/2013 |
| CN | 104050916 | A | | 9/2014 |
| CN | 104464624 | A | | 3/2015 |
| CN | 104715726 | A | | 6/2015 |
| JP | 2004069816 | A | | 3/2004 |

OTHER PUBLICATIONS

Chinese First Office Action for Chinese Application No. 201510160950.5, dated Aug. 29, 2016, 8 Pages.
International Search Report and Written Opinion for Application No. PCT/CN2016/076841, dated Mar. 21, 2016, 13 Pages.

* cited by examiner

PIXEL DRIVING CIRCUIT, PIXEL DRIVING METHOD AND DISPLAY APPARATUS

CROSS-REFERENCE TO RELATED APPLICATION

This application is the U.S. national phase of PCT Application No. PCT/CN2016/076841 filed on Mar. 21, 2016, which claims priority to Chinese Patent Application No. 201510160950.5 filed on Apr. 7, 2015, the disclosures of which are incorporated in their entirety by reference herein.

TECHNICAL FIELD

The present disclosure relates to the field of display technology, in particular to a pixel driving circuit, a pixel driving method and a display apparatus.

BACKGROUND

Active Matrix Organic Light Emitting Diode (AMOLED) panel is more and more widely used. The pixel light-emitting units for AMOLED is organic light-emitting diode (OLED). AMOLED is driven by thin film transistors (TFTs) in a saturated state to generate a driving current, which drive the OLED to emit light. FIG. 1 is a schematic diagram showing a basic pixel driving circuit in the related art. As shown in FIG. 1, the basic pixel driving circuit employs a 2T1C circuit which includes two TFTs (a switching transistor T0 and a driving transistor DTFT), and a storage capacitor C.

However, in the conventional low-temperature polysilicon manufacturing process, the uniformity of the threshold voltage Vth of the respective drive transistors DTFT on the display substrate is poor, and drifts of the threshold voltages occur during application. In this way, when the switching transistor T0 is controlled by the scan line to be turned on so that a same data voltage Vdata is input to the respective driving transistors DTFTs, different driving currents are generated because the threshold voltages of the respective driving transistors DTFTs are different, resulting in poor luminance uniformity of the AMOLED panel.

In addition, OLED will gradually aging, so as to cause brightness attenuation of the OLED display, thereby affecting the user's use.

SUMMARY

To solve the above problems in the related art, the present disclosure provides in some embodiments a pixel driving method, a pixel driving method, and a display device which can effectively eliminate the influence of the threshold voltage of the driving transistor on the driving current of the light emitting device.

To achieve the above object, the present disclosure provides in some embodiments a pixel driving circuit which includes a reset unit, a threshold compensation unit, a data writing unit, a drive transistor, a first storage capacitor and a light emitting device. A control electrode of the drive transistor and a first end of the first storage capacitor are connected at a first node, a second electrode of the drive transistor, a first end of the light emitting device and a second end of the first storage capacitor are connected at a second node, and a second end of the light emitting device is connected to a second power supply. An input end of the reset unit is connected to a third power supply, an output end of the reset unit is connected to the second node, and a control end of the reset unit is connected to a fourth control line. A first input end of the threshold compensation unit is connected to a first power supply, a first output end of the threshold compensation unit is connected to a first electrode of the drive transistor, a first control end of the threshold compensation unit is connected to a third control line, a second input end of the threshold compensation unit is connected to a fourth power supply, a second output end of the threshold compensation unit is connected to the first node, and a second control end of the threshold compensation unit is connected to a first control line. An input end of the data writing unit is connected to a data line, an output end of the data writing unit is connected to the first node, and a control end of the data writing unit is connected to a second control line. The first power supply is configured to provide a first operation voltage, the second power supply is configured to provide a second operation voltage, the third power supply is configured to provide a reset voltage, and the fourth power supply is configured to provide a reference voltage. The reset unit is configured to write the reset voltage into the second node under the control of the fourth control line during a reset period. The threshold compensation unit is configured to write the reference voltage into the first node and write a difference between the reference voltage and a threshold voltage of the drive transistor into the second node under the control of the first control line and the third control line during a threshold compensation period. The data writing unit is configured to write a data voltage of the data line into the first node under the control of the second control line during a data writing period. The threshold compensation unit is further configured to, under the control of the third control line and during a light emitting period, write the first operation voltage into the first electrode of the drive transistor to turn on the drive transistor and enable a driving current provided from the drive transistor to the light emitting device to be uncorrelated to the threshold voltage of the drive transistor.

Optionally, the data writing unit includes a first switch transistor. A first electrode of the first switch transistor is connected to the data line, a second electrode of the first switch transistor is connected to the first node, and a control electrode of the first switch transistor is connected to the second control line.

Optionally, the threshold compensation unit includes a second switch transistor and a third switch transistor. a first electrode of the second switch transistor is connected to the fourth power supply, a second electrode of the second switch transistor is connected to the first node, and a control electrode of the second switch transistor is connected to the first control line; and a first electrode of the third switch transistor is connected to the first power supply, a second electrode of the third switch transistor is connected to the first electrode of the drive transistor, and a control electrode of the third switch transistor is connected to the third control line.

Optionally, the reset unit includes a fourth switch transistor. A first electrode of the fourth switch transistor is connected to the third power supply, a second electrode of the fourth switch transistor is connected to the second node, and a control electrode of the fourth switch transistor is connected to the fourth control line.

Optionally, the pixel driving circuit may further include a second storage capacitor. A first end of the second storage capacitor is connected to the second node, and a second end of the second storage capacitor is floated.

Optionally, the third power supply and the fourth power supply are an identical power supply, which provides the reference voltage during the threshold compensation period and provides the reset voltage during the reset period, the data writing period and the light emitting period.

Optionally, the threshold compensation period includes a first time period and a second time period, and a voltage at the third control line is a turning-off voltage during the first time period and is a turning-on voltage during the second time period, to enable the threshold compensation unit to write the difference between the reference voltage the threshold voltage of the drive transistor into the second node after a voltage at the first node remains at the reference voltage.

Optionally, the second power supply and the third power supply are an identical power supply, which is configured to provide the second operation voltage.

The present disclosure further provides in some embodiments a display apparatus, including the above mentioned pixel driving circuits.

The present disclosure further provides in some embodiments a pixel driving method for the above mentioned pixel driving circuit. the method includes: during a reset period, writing, by the reset unit, the reset voltage into the second node under the control of the fourth control line; during a threshold compensation period, writing the reference voltage into the first node and writing the difference between the reference voltage and the threshold voltage of the drive transistor into the second node by the threshold compensation unit under the control of the first control line and the third control line; during a data writing period, writing, by the data writing unit, the data voltage into the first node under the control of the second control line; during a light emitting period, writing, by the threshold compensation unit and under the control of the third control line, the first operation voltage into the first electrode of the drive transistor to turn on the drive transistor and enable a driving current provided from the drive transistor to the light emitting device to be uncorrelated to the threshold voltage of the drive transistor.

According to the pixel driving circuit, the pixel driving method and the display apparatus in embodiments of the present disclosure, it is able to make the drive current generated by the drive transistor only related to the data voltage and the reference voltage but uncorrelated to the threshold voltage of the drive transistor when the drive transistor drives the light emitting device to display. As a result, the drive current flowing through the light emitting device can be prevented from being affected by the nonuniformity and drift of the threshold voltage, and therefore the uniformity of the drive current can be effectively improved. In addition, since the drive current is also independent of the first operating voltage and the second operating voltage, it is possible to effectively avoid the influence of the voltage drops of the first operating voltage and the second operating voltage in the circuit on the drive current.

DETAILED DESCRIPTION

The pixel driving circuit, the pixel driving method, and the display apparatus according to the embodiments of the present disclosure will be described in detail below in conjunction with the accompanying drawings in order to enable a person skilled in the art to better understand the technical solution of the present disclosure.

Embodiment 1

Figure 1:
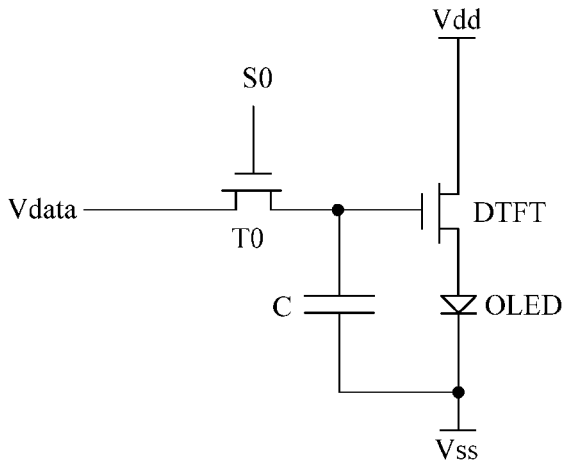
FIG. 1 is a schematic diagram showing a basic pixel driving circuit in the related art.
Figure 2:
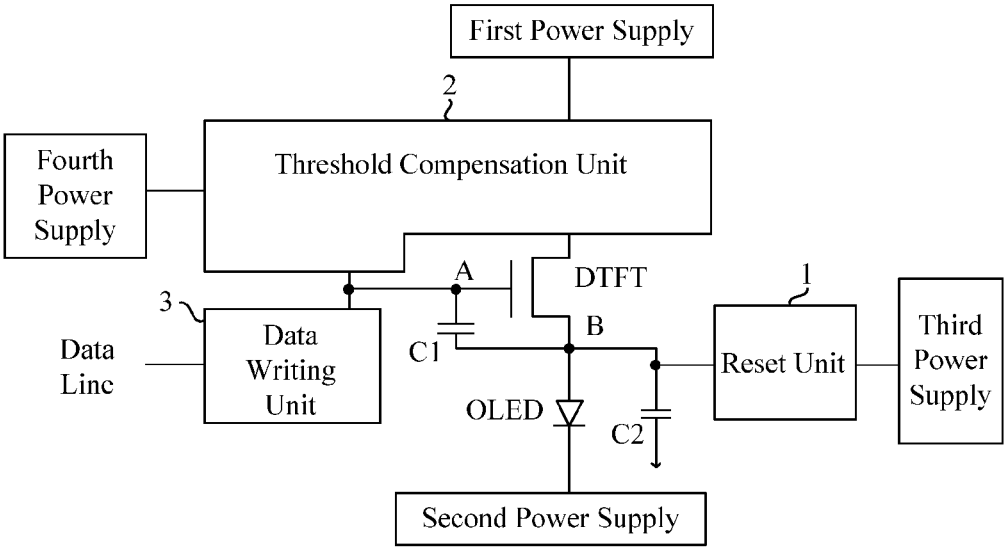
FIG. 2 is a schematic diagram showing a pixel driving circuit according to some embodiments of the present disclosure.

The present embodiment provides a pixel driving circuit. FIG. 2 is a schematic diagram showing the pixel driving circuit. As shown in FIG. 2, the pixel driving circuit includes: a reset unit 1, a threshold compensation unit 2, a data writing unit 3, a drive transistor DTFT, a first storage capacitor C1 and a light emitting device OLED. A gate electrode (i.e., control electrode) of the drive transistor DTFT and a first end of the first storage capacitor C1 are connected at first node A, a second electrode of the drive transistor DTFT, a first end of the light emitting device OLED and a second end of the first storage capacitor C1 are connected at second node B, a second end of the light emitting device OLED is connected to a second power supply. An input end of the reset unit 1 is connected to a third power supply and an output end of the reset unit 1 is connected to the second node B, and a control end of the reset unit 1 is connected to a fourth control line (not shown in FIG. 2). a first input end of the threshold compensation unit 2 is connected to a first power supply, a first output end of the threshold compensation unit 2 is connected to a first electrode of the drive transistor DTFT, a first control end of the threshold compensation unit 2 is connected to a third control line (not shown in FIG. 2), a second input end of the threshold compensation unit 2 is connected to a fourth power supply, a second output end of the threshold compensation unit 2 is connected to the first node A and a second control end of the threshold compensation unit 2 is connected to a first control line (not shown in FIG. 2). An input end of the data writing unit 3 is connected to a data line, an output end of the data writing unit 3 is connected to the first node A, and a control end of the data writing unit 3 is connected to a second control line (not shown in FIG. 2).

The first power supply is configured to provide a first operation voltage, the second power supply is configured to provide a second operation voltage, the third power supply is configured to provide a reset voltage, and the fourth power supply is configured to provide a reference voltage.

The reset unit 1 is configured to write the reset voltage into the second node B under the control of the fourth control line during a reset period.

The threshold compensation unit 2 is configured to write the reference voltage into the first node A, and write a difference between the reference voltage and a threshold voltage of the drive transistor DTFT into the second node B under the control of first control line and third control line and during a threshold compensation period.

The data writing unit 3 is configured to write the data voltage of the data line into the first node A under the control of the second control line during a data writing period.

The threshold compensation unit 2 is further configured to, under the control of the third control line and during a light emitting period, write the first operation voltage into the first electrode of the drive transistor DTFT to turn on the drive transistor DTFT and enable a driving current provided from the drive transistor DTFT to the light emitting device OLED to be uncorrelated to the threshold voltage of the drive transistor DTFT.

Below an operation process of the pixel driving circuit corresponding to FIG. 2 according to the embodiment will be described in detail.

Figure 3:
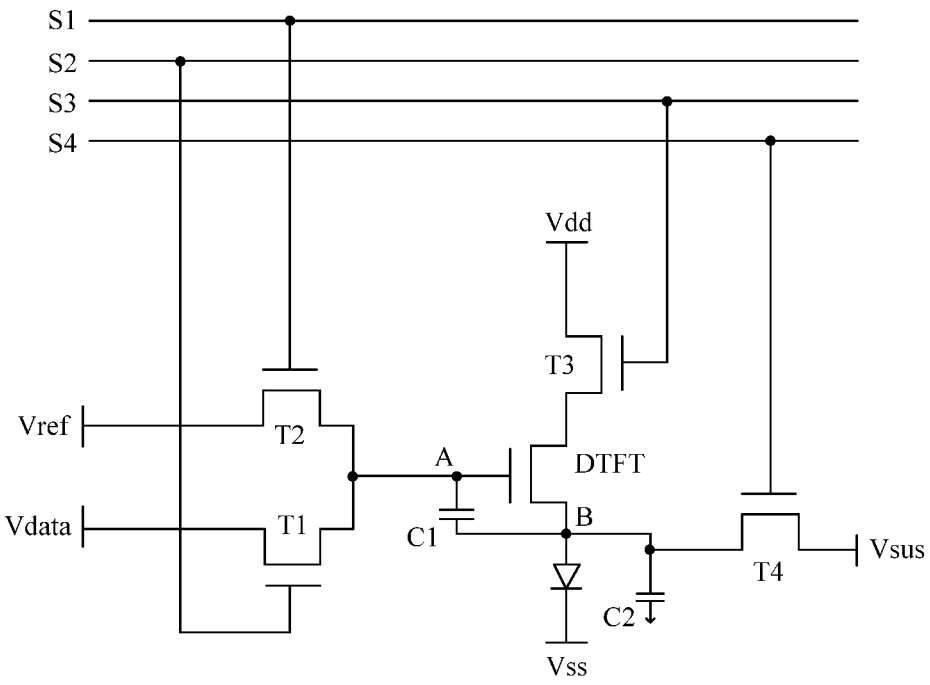
FIG. 3 is another schematic diagram showing the pixel driving circuit according to some embodiments of the present disclosure.

FIG. 3 is a schematic diagram showing a specific pixel driving circuit according to some embodiments of the present disclosure. As shown in FIG. 3, the data writing unit 3 includes a first switch transistor T1, the threshold compensation unit 2 includes a second switch transistor T2 and a third switch transistor T3, and the reset unit 1 includes a fourth switch transistor T4.

As shown, a first electrode of the first switch transistor T1 is connected to the data line, a second electrode of the first switch transistor T1 is connected to the first node A, and a control electrode of the first switch transistor T1 is connected to a second control line S2.

A first electrode of the second switch transistor T2 is connected to a fourth power supply configured to provide the reference voltage Vref, a second electrode of the second switch transistor T2 is connected to the first node A, and a control electrode of the second switch transistor T2 is connected to the first control line S1.

A first electrode of the third switch transistor T3 is connected to a first power supply configured to provide a first operation voltage (for example, Vdd shown in FIG. 3), a second electrode of third switch transistor T3 is connected to a first electrode of the drive transistor DTFT, and a control electrode of the third switch transistor T3 is connected to a third control line S3.

A first electrode of the fourth switch transistor T4 is connected to a third power supply configured to provide the reset voltage Vsus, a second electrode of the fourth switch transistor T4 is connected to the second node B, and a control electrode of the fourth switch transistor T4 is connected to a fourth control line S4.

It should be noted that, in the embodiments of the present disclosure, the light-emitting device is described by taking OLED as an example. However, the light-emitting device may be other current-driven light-emitting device in the related art such as light emitting diode (LED).

In addition, the drive transistor DTFT, the first switch transistor T1, the second switch transistor T2, the third switch transistor T3 and the fourth switch transistor T4 may be any of a polysilicon thin film transistor, an amorphous silicon thin film transistor, an oxide thin film transistor, and an organic thin film transistor.

In the present embodiment, the control electrode refers to a gate electrode of a transistor, the first electrode refers to a source electrode of the transistor and the second electrode refers to a drain electrode of the transistor. Of course, it will be appreciated for a person skilled in the art that the first electrode and the second electrode can be interchanged.

The operation process of the pixel driving circuit shown in FIG. 3 will be described in detail with reference to the drawings. In the following description, the drive transistor DTFT, the first switch transistor T1, the second switch transistor T2, the third switch transistor T3 and the fourth switch transistor T4 are all N-type thin-film transistors. In addition, in FIG. 3, the first operation voltage is of a high level voltage VDD, which may be about 10V; the second operation voltage is a grounded voltage Vss, which may be about 0V; the reference voltage Vref may be about 2V and the reset voltage Vsus may be about between −4V~−5V. It should be understood by a person skilled in the art that the foregoing set-up merely serves as an example and will not limit the technical solution of the present application.

It should be noted that, when the drive transistor DTFT, the first switch transistor T1, the second switch transistor T2, the third switch transistor T3 and the fourth switch transistor T4 are all N-type thin film transistors, all the switch transistors and the drive transistor DTFT in the pixel driving circuit may be manufactured by a same production process simultaneously, which may simplify the production process and shorten the production period.

Figure 4:
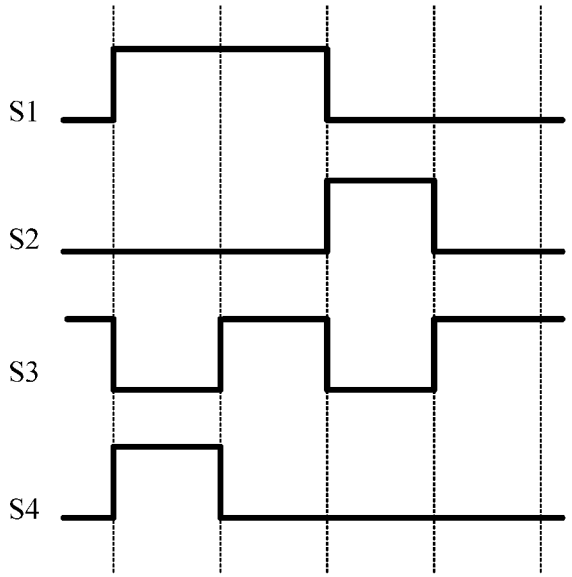
FIG. 4 is a sequence diagram of each control line in the pixel driving circuit shown in FIG. 3.

FIG. 4 is a sequence diagram of each control line in the pixel driving circuit shown in FIG. 3. As shown in FIG. 4, the operation of the pixel drive circuit includes four periods: a reset period, a threshold compensation period, a data writing period and a display period.

During the reset period, the first control line S1 outputs a high level signal, the second control line S2 outputs a low level signal, the third control line S3 outputs a low level signal, and the fourth control line S4 outputs a high level signal. At this time, the second switch transistor T2 and the fourth switch transistor T4 are turned on, while the first switch transistor T1 and the third switch transistor T3 are turned off.

Figure 5:
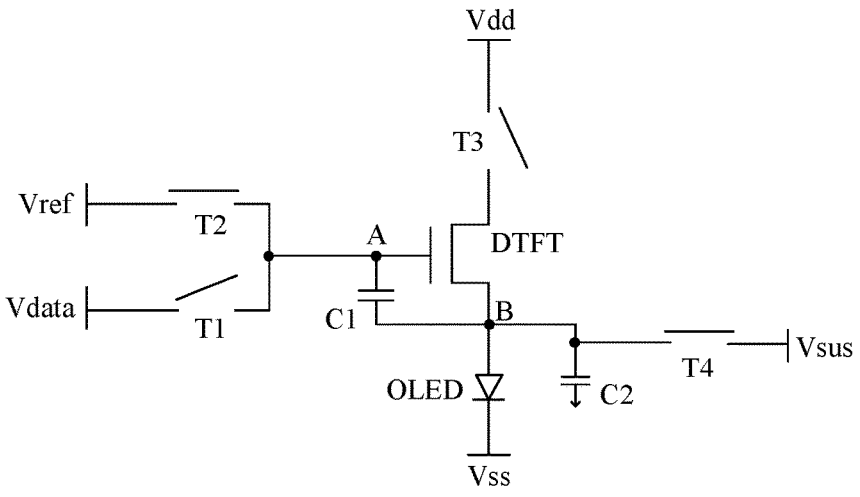
FIG. 5 is an equivalent circuit diagram of the pixel driving circuit shown in FIG. 3 during a reset period.

FIG. 5 is an equivalent circuit diagram of the pixel driving circuit shown in FIG. 3 during the reset period. As shown in FIG. 5, since the second switch transistor T2 and the fourth switch transistor T4 are turned on, the reference voltage Vref is written into the first node A through the second switch transistor T2, and the reset voltage Vsus is written into the second node B through the fourth switch transistor T4, so as to reset the pixel driving circuit. At this time, the voltage at the first node A is the reference voltage Vref, and the voltage at the second node B is the reset voltage Vsus.

During the threshold compensation period, the first control line S1 outputs a high level signal, the second control line S2 outputs a low level signal, the third control line S3 outputs a high level signal, and the fourth control line S4 outputs a low level signal. At this time, the second switch transistor T2 and the third switch transistor T3 are turned on, while the first switch transistor T1 and the fourth switch transistor T4 are turned off.

Figure 6:
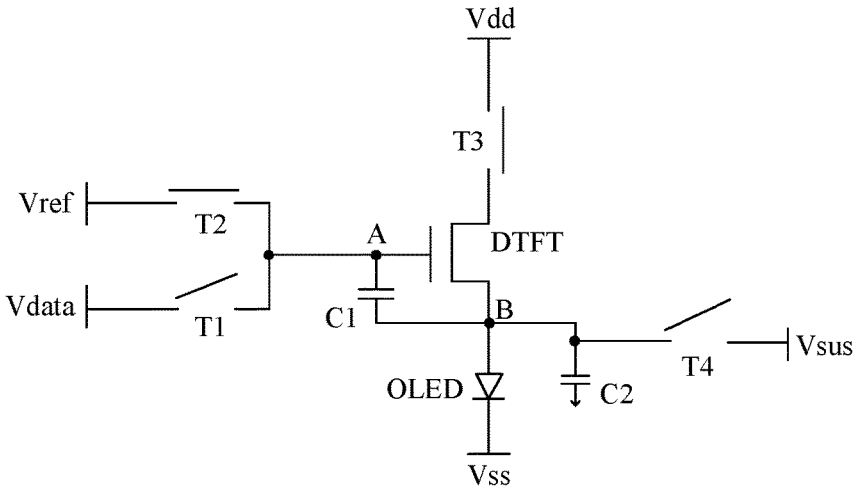
FIG. 6 is an equivalent circuit diagram of the pixel driving circuit shown in FIG. 3 during a threshold compensation period.

FIG. 6 is an equivalent circuit diagram of the pixel driving circuit shown in FIG. 3 during the threshold compensation period. As shown in FIG. 6, since the second switch transistor T2 are still turned on, the voltage at the first node A will maintain at the reference voltage Vref. At the same time, since the third switch transistor T3 is turned on, the second node B is charged by the first operation voltage Vdd through the drive transistor DTFT, and when the gate-source voltage Vgs of the drive transistor DTFT is equal to Vth, the drive transistor DTFT are turned off and the charging is stopped. At this time, the voltage at the second node B is Vref−Vth, where Vth is a threshold voltage of the drive transistor.

During the data writing period, the first control line S1 outputs a low level signal, the second control line S2 outputs a high level signal, the third control line S3 outputs a low level signal, and the fourth control line S4 outputs a low level signal. At this time, the first switch transistor T1 is turned on, the second switch transistor T2, the third switch transistor T3 and the fourth switch transistor T4 are turned off.

Figure 7:
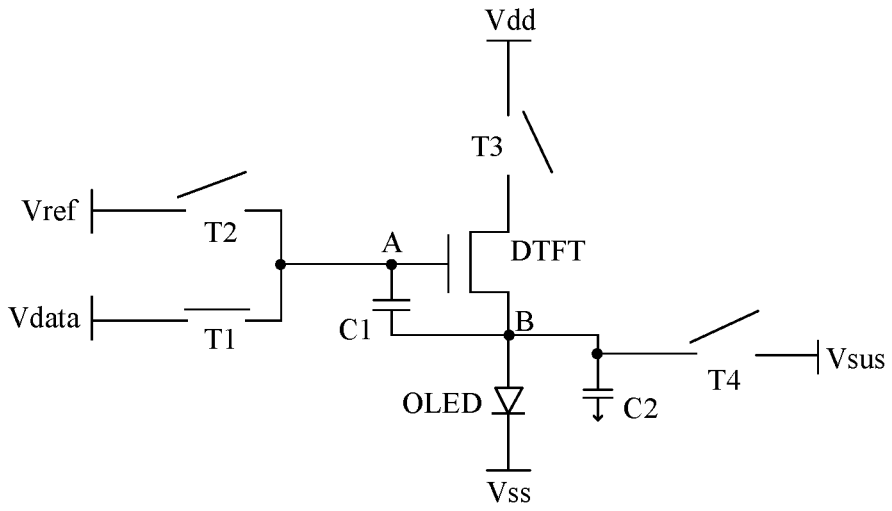
FIG. 7 is an equivalent circuit diagram of the pixel driving circuit shown in FIG. 3 during a data writing period.

FIG. 7 is an equivalent circuit diagram of the pixel driving circuit shown in FIG. 3 during the data writing period. As shown in FIG. 7, since the second switch transistor T2 are turned off and the first switch transistor T1 are turned on, the data voltage Vdata is written into the first node A through the first switch transistor T1. Therefore, the voltage at the first node A changes from the reference voltage Vref to the data voltage Vdata, that is, a voltage at the first end of the first storage capacitor C1 has a voltage change of Vdata−Vref. At this time, a corresponding voltage change, due to the bootstrap effect, is generated at the second end of the first storage capacitor C1. Here, the voltage at the second end of the first storage capacitor C1 is changed to Vref−Vth+α(Vdata−Vref), where a is a voltage change constant. In the circuit as shown in FIG. 3, $$\alpha = \frac{C_{c_1}}{C_{c_1} + C_{OLED}},$$

where $C_{c_1}$ is a capacitance value of the first storage capacitor C1 and $C_{OLED}$ is a capacitance value of the light emitting device OLED.

After the data writing period, the voltage at the first node A is the data voltage Vdata, and the voltage at the second node B is Vref−Vth+α(Vdata−Vref).

During a display period, the first control line S1 outputs a low level signal, the second control line S2 outputs a low level signal, the third control line S3 outputs a high level signal, and the fourth control line S4 outputs a low level signal. At this time, the third switch transistor T3 is turned on, the first switch transistor T1, the second switch transistor T2 and the fourth switch transistor T4 are all turned off.

Figure 8:
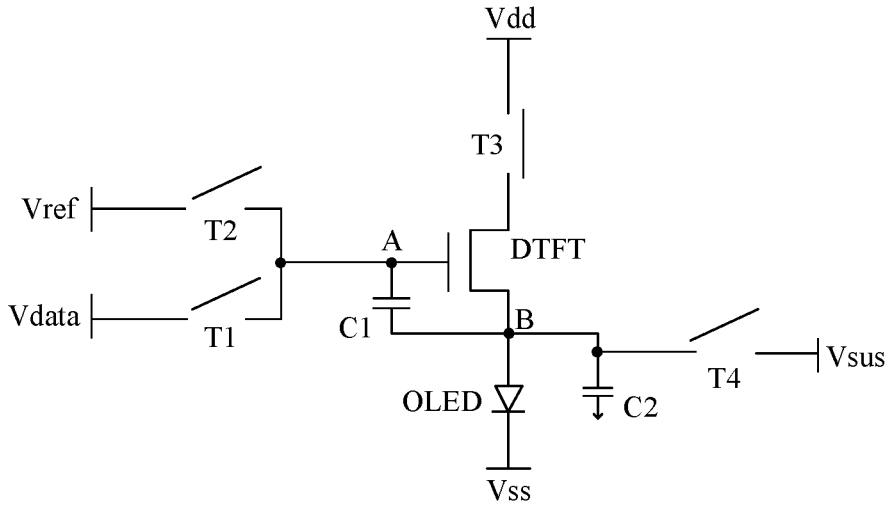
FIG. 8 is an equivalent circuit diagram of the pixel driving circuit shown in FIG. 3 during a display period.

FIG. 8 is an equivalent circuit diagram of the pixel driving circuit shown in FIG. 3 during the display period. As shown in FIG. 8, since the third switch transistor T3 are turned on, the first power supply provides the first operation voltage Vdd for the drive transistor DTFT, so as to enable the drive transistor DTFT to be in an operation state.

Based on a saturation drive current formula of the drive transistor DTFT, it can be known that:

$$\begin{aligned} I &= K*(Vgs - Vth)^2 \\ &= K*\{Vdata - [Vref - Vth + \alpha(Vdata - Vref)] - Vth\}^2 \\ &= K*[(1-\alpha)(Vdata - Vref)]^2 \end{aligned}$$

where K and α are constant and Vgs is the gate-source voltage of the drive transistor DTFT.

It can be seen from above that, the drive current I of the drive transistor DTFT is merely related to the data voltage Vdata and the reference voltage Vref but uncorrelated to the threshold voltage Vth of the drive transistor DTFT. As a result, the drive current flowing through the light emitting device can be prevented from being affected by the nonuniformity and drift of the threshold voltage, and therefore the uniformity of the drive current can be effectively improved. In addition, since the drive current is also uncorrelated to the first operating voltage Vdd and the second operating voltage Vss, it is possible to effectively avoid the influence of the voltage drops of the first operating voltage Vdd and the second operating voltage Vss in the circuit on the drive current.

Figure 9:
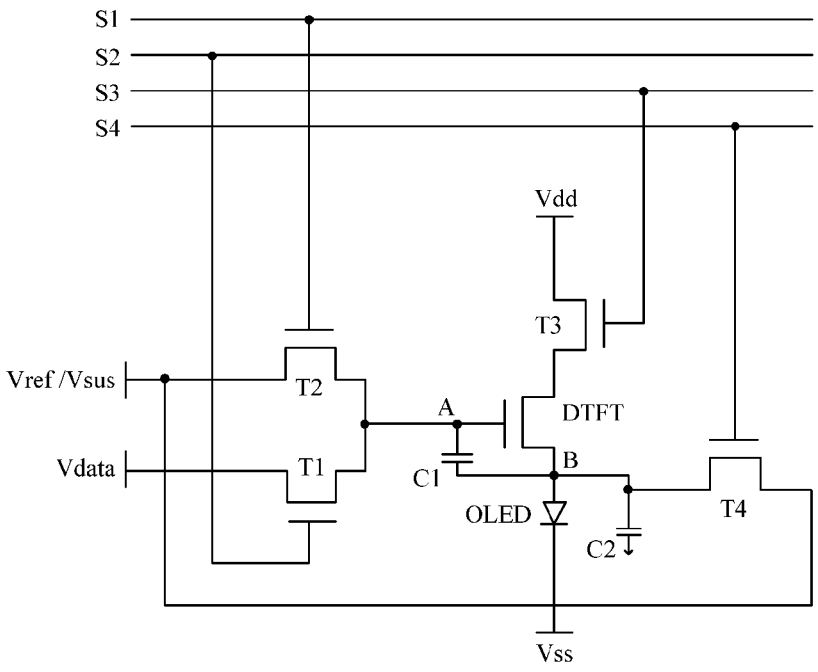
FIG. 9 is yet another schematic diagram showing the pixel driving circuit according to some embodiments of the present disclosure.
Figure 10:
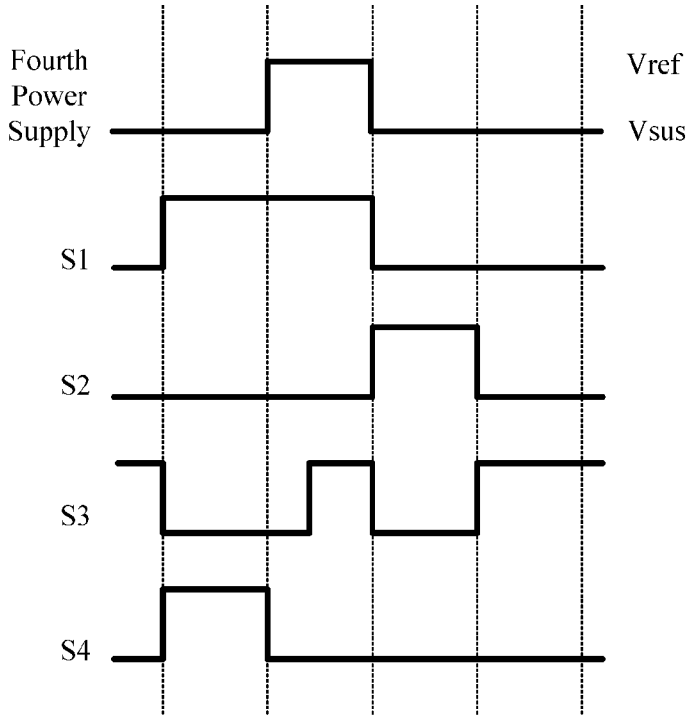
FIG. 10 is a sequence diagram of each control line and a fourth power supply in the pixel driving circuit of FIG. 9.

FIG. 9 is another schematic diagram showing the pixel driving circuit according to some embodiments of the present disclosure. FIG. 10 is a sequence diagram of each control line and a fourth power supply in the pixel driving circuit of FIG. 9. The pixel driving circuit shown in FIG. 9 differs from the pixel driving circuit shown in FIG. 3 in that, in the pixel driving circuit shown in FIG. 9, the first electrode of the fourth switch transistor T4 is connected to the fourth power supply, that is, the third power supply and the fourth power supply are an identical power supply (the fourth power supply in FIG. 10). As shown in FIG. 10, the fourth power supply provides the reference voltage Vref (corresponding to a high level on the fourth power supply shown in FIG. 10) during the threshold compensation period, and provides the reset voltage Vsus (corresponding to a low level on the fourth power supply shown in FIG. 10) during the reset period, the data writing period and the light emitting period. Since the third power supply is omitted in the pixel driving circuit shown in FIG. 9, the corresponding power lines may be omitted for the pixel driving circuit, thereby saving the wiring space.

It should be noted that, instantaneous power consumption may be generated when the fourth power supply switches between the reference voltage and the reset voltage; however, since the difference between the absolute values of the reference voltage and the reset voltage is small, the instantaneous power consumption is small, too.

In addition, compared with the sequence diagram of each control line in FIG. 4, in FIG. 10, only the sequence of the third control line S3 is different while the others remain the same. When the fourth power supply enters the threshold compensation period from the reset period, the voltage output by the fourth power supply is changed from the reset voltage Vsus to the reference voltage Vref. At this time, the voltage at the first node A needs to increase from the reset voltage Vsus to the reference voltage Vref, which needs a period of time. In order to ensure the threshold voltage Vth of the drive transistor DTFT to be precisely written into the first storage capacitor C1, it is necessary for the third switch transistor T3 to be turned on after the voltage at the first node A remains at the reference voltage Vref, so as to write the difference between the reference voltage Vref and the threshold voltage Vth of the drive transistor DTFT into the second node B. To be specific, the threshold compensation period may include a first time period and a second time period. When the threshold compensation period begins, the third control line S3 at first maintains a low level signal during the first time period and then outputs a high level signal during the second time period.

The operation process of the pixel driving circuit shown in FIG. 9 is similar to that shown in FIG. 3, and the description thereof is omitted here.

Figure 11:
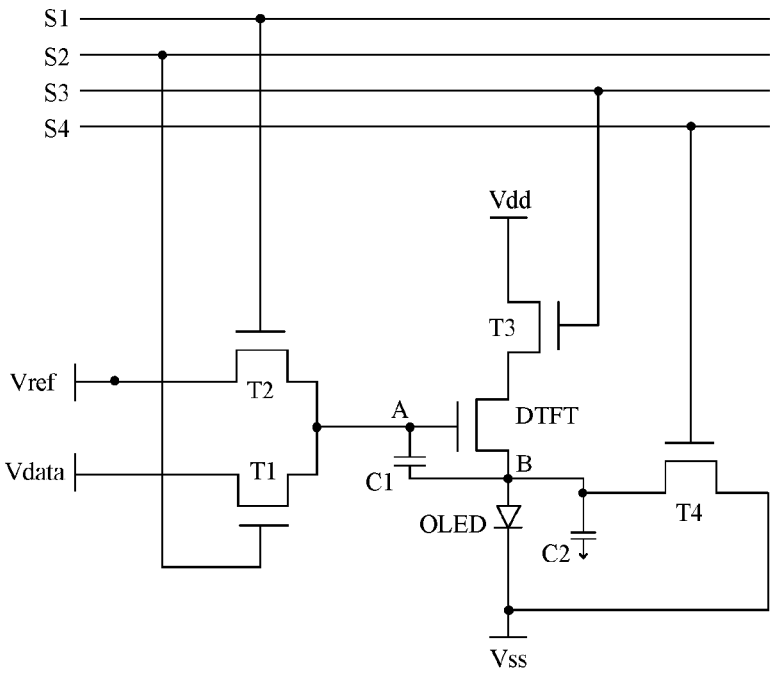
FIG. 11 is still another schematic diagram showing the pixel driving circuit according to some embodiments of the present disclosure.

FIG. 11 is still another schematic diagram showing the pixel driving circuit according to some embodiments of the present disclosure. The pixel driving circuit shown in FIG. 11 differs from the pixel driving circuit shown in FIG. 3 in that, in the pixel driving circuit shown in FIG. 11, the first electrode of the fourth switch transistor T4 is connected to the second power supply, that is, the second power supply and the third power supply are an identical power supply (the second power supply). The second power supply continuously outputs the second operation voltage Vss. Since in the pixel driving circuit shown in FIG. 11, the third power supply is omitted, the corresponding Power Line may also be omitted, thereby saving the wiring space.

It should be noted that, the operation sequence of each control line of the pixel driving circuit shown in FIG. 11 is similar to that shown in FIG. 4, and the description is omitted here.

It should be noted that, in some embodiments, for the pixel driving circuit shown in any of FIG. 2, FIG. 3, FIG. 5-FIG. 9 and FIG. 11, it may further includes a second storage capacitor C2. A first end of the second storage capacitor C2 is connected to the second node B, and a second end of the second storage capacitor C2 is floated. In the pixel driving circuits according to the embodiments, the number of elements connected at the second node B is large, so that leakage current is liable to be generated, and the voltage at the second node B is unstable. In the present disclosure, by providing the second storage capacitor C2 at the second node B, the voltage of the second node B can be stabilized, thereby ensuring that the drive current generated by the drive transistor is more stable.

Embodiment 2

Figure 12:
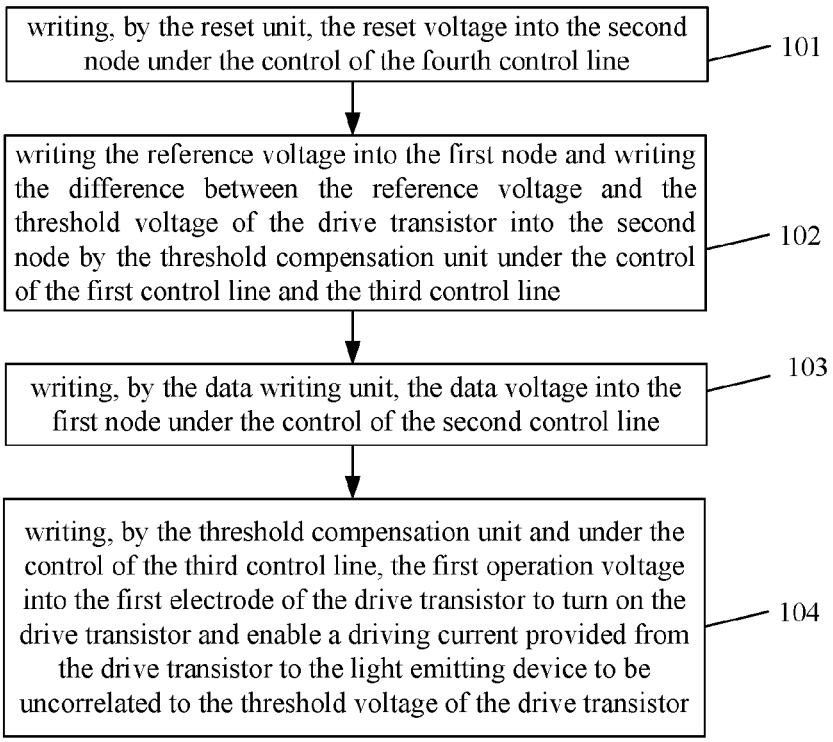
FIG. 12 is a flow chart of a pixel driving method according to some embodiments of the present disclosure.

The present embodiment provides a pixel driving method. FIG. 12 is a flow chart of the pixel driving method. The pixel driving method is based on the above mentioned pixel driving circuit. As shown in FIG. 12, the pixel driving method includes the following steps 101-104.

Step 101: writing, by the reset unit, the reset voltage into the second node under the control of the fourth control line;

Step 102: writing the reference voltage into the first node and writing the difference between the reference voltage and the threshold voltage of the drive transistor into the second node by the threshold compensation unit under the control of the first control line and the third control line;

Step 103: writing, by the data writing unit, the data voltage into the first node under the control of the second control line;

Step 104: writing, by the threshold compensation unit and under the control of the third control line, the first operation voltage into the first electrode of the drive transistor to turn on the drive transistor and enable a driving current provided from the drive transistor to the light emitting device to be uncorrelated to the threshold voltage of the drive transistor.

Steps 101-104 sequentially correspond to four operation period of the pixel driving circuit i.e., the reset period, the threshold compensation period, the data writing period and the light emitting period. The details of the specific process can refer to the above embodiments and therefore will be omitted.

The present disclosure further provides in some embodiments a pixel driving method. According to this pixel driving method, it is able to make the drive current generated by the drive transistor only related to the data voltage and the reference voltage but uncorrelated to the threshold voltage of the drive transistor when the drive transistor drives the light emitting device to display. As a result, the drive current flowing through the light emitting device can be prevented from being affected by the nonuniformity and drift of the threshold voltage, and therefore the uniformity of the drive current can be effectively improved. In addition, since the drive current is also uncorrelated to the first operating voltage and the second operating voltage, it is possible to effectively avoid the influence of the voltage drops of the first operating voltage and the second operating voltage in the circuit on the drive current.

Embodiment 3

The present disclosure further provides in some embodiments a display apparatus. The display apparatus includes a plurality of pixel units, each of the pixel units is provided with a corresponding pixel driving circuit according to the above embodiments. In addition, the pixel driving circuit can be operated according to the above mentioned method.

It can be understood that the above embodiments are merely exemplary embodiments employed for the purpose of illustrating the principles of the present disclosure, but the disclosure is not limited thereto. It will be apparent to a person skilled in the art that various changes and modifications can be made therein without departing from the scope of the disclosure.

What is claimed is:

1. A pixel driving circuit, comprising: a reset unit, a threshold compensation unit, a data writing unit, a drive transistor, a first storage capacitor, a second storage capacitor and a light emitting device, wherein a control electrode of the drive transistor and a first end of the first storage capacitor are connected at a first node, a second electrode of the drive transistor, a first end of the light emitting device and a second end of the first storage capacitor are connected at a second node, and a second end of the light emitting device is connected to a second power supply;

an input end of the reset unit is connected to a third power supply, an output end of the reset unit is connected to the second node, and a control end of the reset unit is connected to a fourth control line;

a first input end of the threshold compensation unit is connected to a first power supply, a first output end of the threshold compensation unit is connected to a first electrode of the drive transistor, a first control end of the threshold compensation unit is connected to a third control line, a second input end of the threshold compensation unit is connected to a fourth power supply, a second output end of the threshold compensation unit is connected to the first node, and a second control end of the threshold compensation unit is connected to a first control line;

an input end of the data writing unit is connected to a data line, an output end of the data writing unit is connected to the first node, and a control end of the data writing unit is connected to a second control line;

the first power supply is configured to provide a first operation voltage, the second power supply is configured to provide a second operation voltage, the third power supply is configured to provide a reset voltage, and the fourth power supply is configured to provide a reference voltage;

the reset unit is configured to write the reset voltage into the second node under the control of the fourth control line during a reset period;

the threshold compensation unit is configured to write the reference voltage into the first node and write a difference between the reference voltage and a threshold voltage of the drive transistor into the second node under the control of the first control line and the third control line during a threshold compensation period;

the data writing unit is configured to write a data voltage at the data line into the first node under the control of the second control line during a data writing period;

the threshold compensation unit is further configured to, under the control of the third control line and during a light emitting period, write the first operation voltage into the first electrode of the drive transistor to turn on the drive transistor and enable a driving current provided from the drive transistor to the light emitting device to be uncorrelated to the threshold voltage of the drive transistor;

a first end of the second storage capacitor is connected to the second node, and a second end of the second storage capacitor is floated.

2. The pixel driving circuit according to claim 1, wherein the data writing unit comprises a first switch transistor;

a first electrode of the first switch transistor is connected to the data line, a second electrode of the first switch transistor is connected to the first node, and a control electrode of the first switch transistor is connected to the second control line.

3. The pixel driving circuit according to claim 1, wherein the threshold compensation unit comprises a second switch transistor and a third switch transistor;

a first electrode of the second switch transistor is connected to the fourth power supply, a second electrode of the second switch transistor is connected to the first node, and a control electrode of the second switch transistor is connected to the first control line; and a first electrode of the third switch transistor is connected to the first power supply, a second electrode of the third switch transistor is connected to the first electrode of the drive transistor, and a control electrode of the third switch transistor is connected to the third control line.

4. The pixel driving circuit according to claim 1, wherein the reset unit comprises a fourth switch transistor;

a first electrode of the fourth switch transistor is connected to the third power supply, a second electrode of the fourth switch transistor is connected to the second node, and a control electrode of the fourth switch transistor is connected to the fourth control line.

5. The pixel driving circuit according to claim 1, wherein the third power supply and the fourth power supply are an identical power supply, which provides the reference voltage during the threshold compensation period and provides the reset voltage during the reset period, the data writing period and the light emitting period.

6. The pixel driving circuit according to claim 5, wherein the threshold compensation period comprises a first time period and a second time period, and a voltage at the third control line is a turning-off voltage during the first time period and is a turning-on voltage during the second time period, to enable the threshold compensation unit to write the difference between the reference voltage the threshold voltage of the drive transistor into the second node after a voltage at the first node remains at the reference voltage.

7. The pixel driving circuit according to claim 1, wherein the second power supply and the third power supply are an identical power supply, which is configured to provide the second operation voltage.

8. A display apparatus, comprising the pixel driving circuit according to claim 1.

9. The display apparatus according to claim 8, wherein the data writing unit comprises a first switch transistor;

a first electrode of the first switch transistor is connected to the data line, a second electrode of the first switch transistor is connected to the first node, and a control electrode of the first switch transistor is connected to the second control line.

10. The display apparatus according to claim 8, wherein the threshold compensation unit comprises a second switch transistor and a third switch transistor;

a first electrode of the second switch transistor is connected to the fourth power supply, a second electrode of the second switch transistor is connected to the first node, and a control electrode of the second switch transistor is connected to the first control line; and a first electrode of the third switch transistor is connected to the first power supply, a second electrode of the third switch transistor is connected to the first electrode of the drive transistor, and a control electrode of the third switch transistor is connected to the third control line.

11. The display apparatus according to claim 8, wherein the reset unit comprises a fourth switch transistor;

a first electrode of the fourth switch transistor is connected to the third power supply, a second electrode of the fourth switch transistor is connected to the second node, and a control electrode of the fourth switch transistor is connected to the fourth control line.

12. The display apparatus according to claim 8, wherein the third power supply and the fourth power supply are an identical power supply, which provides the reference voltage during the threshold compensation period and provides the reset voltage during the reset period, the data writing period and the light emitting period.

13. The display apparatus according to claim 12, wherein the threshold compensation period comprises a first time period and a second time period, and a voltage at the third control line is a turning-off voltage during the first time period and is a turning-on voltage during the second time period, to enable the threshold compensation unit to write the difference between the reference voltage the threshold voltage of the drive transistor into the second node after a voltage at the first node remains at the reference voltage.

14. The display apparatus according to claim 8, wherein the second power supply and the third power supply are an identical power supply, which is configured to provide the second operation voltage.

15. A pixel driving method for the pixel driving circuit according to claim 1, the method comprising:

during a reset period, writing, by the reset unit, the reset voltage into the second node under the control of the fourth control line;

during a threshold compensation period, writing the reference voltage into the first node and writing the difference between the reference voltage and the threshold voltage of the drive transistor into the second node by the threshold compensation unit under the control of the first control line and the third control line;

during a data writing period, writing, by the data writing unit, the data voltage into the first node under the control of the second control line;

during a light emitting period, writing, by the threshold compensation unit and under the control of the third control line, the first operation voltage into the first electrode of the drive transistor to turn on the drive transistor and enable a driving current provided from the drive transistor to the light emitting device to be uncorrelated to the threshold voltage of the drive transistor.

* * * * *